United States Patent [19]

Iuchi et al.

[11] Patent Number: 4,734,127

[45] Date of Patent: Mar. 29, 1988

[54] PROCESS AND APPARATUS FOR REFINING ALUMINUM

[75] Inventors: Toshiaki Iuchi, Shizuoka; Kaoru Sugita, Fuji; Eikichi Sagisaka, Shimizu; Norio Tuchihashi; Terumi Kanamori, both of Shizuoka; Masaharu Sugiyama, Numazu, all of Japan

[73] Assignee: Nippon Light Metal Co., Ltd., Tokyo, Japan

[21] Appl. No.: 656,998

[22] Filed: Oct. 2, 1984

[51] Int. Cl.[4] ..... C22B 21/06

[52] U.S. Cl. ..... 75/10.11; 75/63; 75/68 R; 373/111; 373/113; 373/116

[58] Field of Search ..... 75/10 R, 10 P, 63, 68 R; 373/111, 116, 113, 136

[56] References Cited

U.S. PATENT DOCUMENTS.

| | | | |
|---|---|---|---|
| 3,671,229 | 6/1972 | Ferber et al. | 75/68 R |
| 4,043,802 | 8/1977 | Esdaile et al. | 75/68 R |
| 4,138,247 | 2/1979 | Esdaile et al. | 75/68 R |
| 4,221,590 | 9/1980 | Dawless et al. | 75/10 R |
| 4,456,480 | 6/1984 | Wintenberger | 75/68 R |

FOREIGN PATENT DOCUMENTS

| | | |
|---|---|---|
| 167733 | 10/1983 | Japan . |
| 20431 | 2/1984 | Japan . |

*Primary Examiner*—Melvyn J. Andrews

*Attorney, Agent, or Firm*—Oblon, Fisher, Spivak, McClelland & Maier

[57] ABSTRACT

A process for refining aluminum using a segregation solidification process under a positive pressure inert gas protecting atmosphere comprising, maintaining the temperature of molten aluminum in the vessel by a plurality of electric heater sections arranged around the periphery of said vessel in vertically superposed relationship to each other, cooling a narrow peripheral portion of the inner surface of said vessel beneath the level of the molten aluminum therein by means of a peripheral cooling section arranged around the periphery of said vessel between adjacent heater sections to crystallize the molten aluminum onto said peripheral portion of the inner surface of said vessel, scraping off the refined and solidified aluminum on said peripheral portion by scraping and tamping means having a cross-sectional configuration complementary to that of the inner surface of said vessel, tamping the heaped aluminum by said scraping and tamping means, and deenergizing some of said heater sections located at positions around the solidified heap of aluminum.

8 Claims, 6 Drawing Figures

PROCESS AND APPARATUS FOR REFINING ALUMINUM

BACKGROUND OF THE INVENTION

The present invention relates to a process for refining aluminum using segregation solidification process of molten aluminum.

Heretofore, various process have been proposed for refining metal such as aluminum using segregation solidification process of molten metal as disclosed in U.S. Pat. No. 3,671,229, for example. The process disclosed in this patent comprises the steps of penetrating a vertically movable cooling blind tube made of graphite and cooled by compressed gas circulated therein into the molten metal contained in a graphite vessel which is closed by a cover so as to maintain the atmosphere in the vessel under the condition protected by inert gas and fitted in a steel crucible heated from the outside by a heater located in a vertical kiln through a heat insulation structure so that the molten metal in the vessel is held at an appropriate temperature, thereby permitting the molten metal to be partially crystallized into the outer surface of the cooling tube under refined or purified condition to generate purified primary crystal of the metal, scraping off the thus solidified metal from the outer surface of the cooling tube by moving downwardly on annular scraping and tamping plate arranged around the cooling tube and having therein an opening of the cross-sectional configuration substantially complementary to that of the cooling tube thereby depositing the scraped metal into the bottom of the graphite vessel, then tamping or compacting the deposited metal by the scraping and tamping plate so as to press out impure liquid existing within the tamped metal upwardly above the tamped metal, while the tamped metal is partially molten so that purified crystal of the metal is rendered to grow.

In such a process, however, the cooling surface area of the cooling tube is relatively small and is gradually reduced, because the cooling tube must be raised gradually as the level of the tamped metal rises in the course of the partial crystallization, scraping and tamping operation of the metal, while the level of the molten metal in the vessel is substantially held constant thereby lowering the efficiency of refining the metal. Further, the scraping and tamping plate might move out from the lower end of the cooling tube when the scraping and tamping plate is lowered for the tamping of the deposited metal.

SUMMARY OF THE INVENTION

The present invention aims at avoiding the above described disadvantages of the prior art process.

Therefore, an object of the present invention is to provide a process for refining aluminum using segregation solidification process which positively avoids the above described disadvantages of the prior art process.

Another object is to provide a process of the type described above which insures a constant large cooling area for partial crystallization of aluminum throughout the process so that a high efficiency and a high productivity are obtained while the electric power required for the process is kept to the minimum.

A further object is to provide an apparatus for carrying out the above described process of the present invention which is simple in construction and operation.

In accordance with the characteristic feature of the present invention, the above object is achieved by the provision of a process for refining aluminum using segregation solidification process under the atmosphere protected by positive pressure inert gas including the steps of pouring molten aluminum into a vessel, heating the vessel so as to maintain the molten aluminum therein at an appropriate temperature, partially crystallizing the molten aluminum by a cooling surface area located in the vessel so as to form primary crystal of aluminum under refined condition onto the cooling surface area, scraping off the thus refined and solidified aluminum from the area thereby permitting the scraped aluminum to be deposited and heaped up onto the bottom of the vessel, tamping the thus deposited heap of aluminum so as to press out the impure liquid existing within the heap of the solidified aluminum upwardly of the level of the tamped aluminum, removing the liquid existing above the thus tamped heap of aluminum, and taking out the tamped aluminum from the vessel, the process being characterized by the steps of maintaining the temperature of the molten aluminum in the vessel appropriately by means of a plurality of electric heater segments or sections arranged around the periphery of the vessel in vertically superposed relationship to each other, cooling a relatively narrow peripheral portion of the inner surface of the vessel beneath the level of the molten aluminum therein by means of a peripheral cooling section or passage arranged around the periphery of the vessel between adjacent two heater sections so as to crystallize the molten aluminum onto the peripheral portion of the inner surface of the vessel, scraping off the thus refined and solidified aluminum from the peripheral portion by scraping and tamping means having the cross-sectional configuration substantially complementary to that of the inner surface of the vessel, tamping the deposited heaped aluminum by the scraping and tamping means, and deenergizing only some of the heater sections located at positions around the thus solidified heap of aluminum.

With the process described above, a large cooling area for the partial crystallization of the molten aluminum is kept constant during the course of the refining of aluminum afforded by virtue of the large area of the peripheral portion of the inner surface of the vessel.

The scraping and tamping means is provided with at least a throughhole so as to permit the scraped aluminum existing above the scraping and tamping means in floating condition which is growing to larger purified crystal to be deposited onto the bottom of the vessel.

The time interval of scraping operation is preferably in the order of 5–120 seconds and the scraping speed is preferably set to be in the order of 10–200 cm/min and they depend upon the cooling condition.

The deposited aluminum on the bottom of the vessel is tamped or compacted by the scraping and tamping means so that impure liquid existing within the tamped aluminum is pressed out therefrom upwardly above the level of the tamped aluminum thereby achieving a highly purified or refined heap of aluminum. The time interval of the tamping operation is preferably in the order of 3–30 seconds.

In the present invention, the zone of the tamping of aluminum is held at a desired raised temperature of 690° C., for example, for allowing aluminum to be partially molten to render purified crystal to grow, while the zone above the tamping zone is preferably held at a temperature in the order of 660° C. for maintaining aluminum in the molten state, and the heating sections are successively deenergized or the electric power supplied thereto is reduced beginning at the lowermost are positioned in the zone of the already solidified and refined aluminum as the level of the solidified aluminum rises in the course of partial crystallization of aluminum so as to save the electric power required for the refining of aluminum.

In accordance with another feature of the present invention, an apparatus for carrying out the above process is provided which comprises a vessel for maintaining molten aluminum therein, a cover for keeping the interior of the vessel under the atmosphere protected by positive pressure insert gas, heating means for maintaining the molten aluminum in the vessel at an appropriate temperature, a cooling surface area located in the vessel for partially crystallizing the molten aluminum onto the cooling surface area, and scraping and tamping means for scraping off the solidified aluminum on the cooling surface area so as to deposit the same onto the bottom fo the vessel and tamping the thus deposited aluminum for pressing out impure liquid existing within the deposited aluminum, the apparatus being characterized in that the heating means comprises a plurality of electric heater segments or sections arranged around the periphery of the vessel in vertically superposed relationship to each other, and the cooling surface area comprises a relatively narrow peripheral portion of the inner surface of the vessel beneath the level of the molten aluminum in vessel cooled by a cooling section or passage located around the periphery of the vessel between adjacent two heating sections, while the scraping and tamping means comprises a scraping and tamping plate having the cross-sectional configuration substantially complementary to that of the inner surface of the vessel.

With the above described apparatus, the process of the present invention can be most efficiently and economically carried out while the construction and opeartion are made simple.

In the present invention, the scraping and tamping plate is driven by a rod secured thereto and extending upwardly therefrom with a portion of the rod being adapted to pass through a hole formed in the cover.

In order to positively prevent the rod from being cooled to result in crystallization of the molten aluminum onto the outer surface of the rod, the rod may comprise an electric heater section extending in the rod to prevent the molten aluminum from solidifying onto the outer surface of the rod during the partial crystallization of aluminum onto the peripheral cooling portion of the inner surface of the vessel.

Alternatively, the apparatus of the present invention may comprise an upwardly extending cylindrical member secured to the cover so as to loosely receive the rod and a heater section arranged around the periphery of the cylidrical member so as to positively maintain the temperature of the rod at an appropriate raised temperature by the heater section during the partial crystallization of the molten aluminum to prevent the molten aluminum from solidifying onto the outer surface of the rod during the partial crystallization of aluminum onto the peripheral cooling portion of the inner surface of the vessel.

Further, in the present invention, a plurality of cooling sections may be arranged around the periphery of the vessel in vertically superposed relationship to each other with at least a heater section being located at either side each of the cooling sections, the cooling sections being rendered to be inoperative beginning at the lowermost one as the level of the tamped heap of aluminum reaches the cooling section concerned.

This construction makes it possible to widely enhance the productivity of the refining of aluminum.

Further, the scraping and tamping plate may be in the form of two separate plates from each other, the scraping plate being driven by at least a rod secured thereto and extending upwardly therefrom separately of the actuation of the separate tamping plate driven by another rod secured thereto and extending upwardly therefrom through the scraping plate. Since the time at which the tamping plate is to be operated and the time interval for the operation are different from those of the scraping plate, the construction of the tamping plate separate from the scraping plate greatly improves the efficiency of the process.

BRIEF DESCRIPTION OF THE DRAWINGS

The present invention will be described below with reference to the preferred embodiments thereof illustrated in the accompanying drawings, in which.

DETAILED DESCRIPTION OF THE PREFERRED EMBODIMENTS

Figure 1:
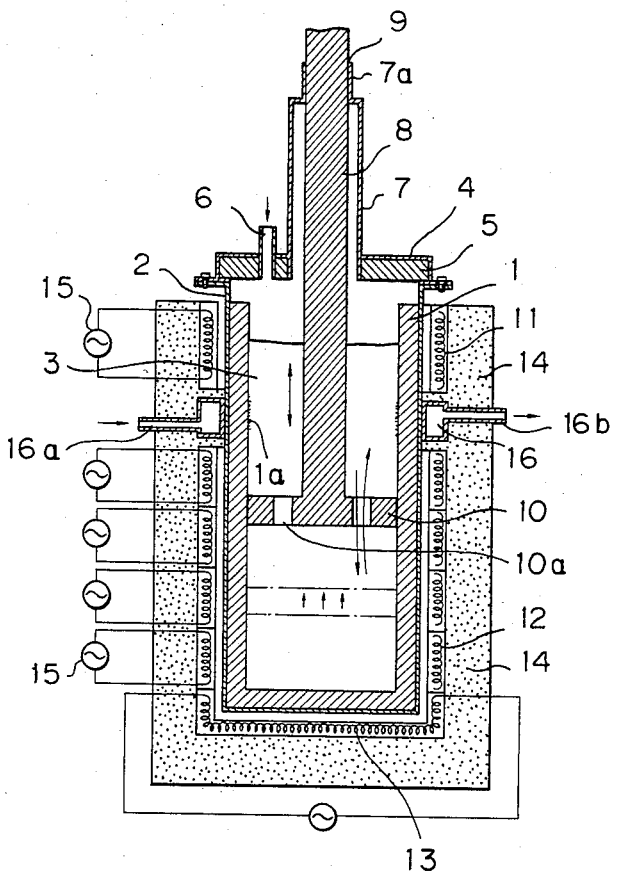
FIG. 1 is a vertical cross-sectional view showing a first embodiment of the apparatus for refining aluminum using segregation solidification process in accordance with the present invention.

Referring to FIG. 1, a graphite crucible or vessel 1 fitted in a stainless steel vessel 2 contains therein the molten aluminum 3, and a stainless steel cover 4 lined with heat insulating bricks 5 is secured with its peripheral edge to the upper flange of the stainlesss steel vessel 2 so as to seal the interior of the vessel 1 from the environment.

The cover 4 and the brickes 5 are provided with an inlet 6 for introducing positive pressure inert gas such as Ar from the supply source (not shown) into the interior of the vessel 1 as well as an upwardly extending cylindrical member 7 at the center of the cover 4.

A vertical graphite rod 8 slidably passes through the upper constricted end 7*a* of the member 7 into the interior of the vessel 1 with a narrow annular clearance 9 formed between the rod 8 and the constricted end 7*a*. The positive pressure inert gas introduced in the interior of the vessel 1 leaks out through the annular clearance 9 so that the interior of the vessel 1 is kept under the atmosphere protected by the inert gas. A graphite scraping and tamping plate 10 is integrally secured at its center to the lower end of the rod 8. The cross-sectional configuration of the plate 10 is substantially complementary to that of the vessel 1 which may be circular or may be of any shape, and the plate 10 is formed with at least a through hole 10*a*. Alternatively, at least a cut-out portion (not shown) may be formed in the periphery of the plate 10 in place of the throughhole 10*a*.

The rod 8 is reciprocally driven upwardly and downwardly by a driving device (not shown) arranged outside the vessel 1, the function of which will be described below.

An upper electric heater segment or section 11 and a plurality of electric heater segments or sections 12 are arranged around the periphery of the stainless steel vessel 2 and a bottom electric heater segment or section 13 is arranged under the bottom of the stainless steel vessel 2. Heat insulating bricks 14 are arranged to surround these heated sections 11, 12, 13. Each of the heater sections is provided with a temperature regulating device 15 so that the temperature of the respective heater sections is controlled so as to achieve the required temperature distribution of aluminum in the vessel along the height of the vessel 1.

An annular cooling section or passage 16 made of stainless steel is located around the periphery of the stainless steel vessel 2 between the upper heater section 11 and heater section 12. The cooling passage 16 is provided with an inlet 16*a* for introducing cooling gas such as compressed air into the cooling passage 16 at a position thereof and an outlet 16*b* for discharging the cooling gas at the opposite position to the inlet 16*a* after cooling.

The operation of the apparatus described above is as follows.

The molten aluminum 3 is poured into the vessel 1 by removing the cover 4 and the scraping and tamping plate 10 from the vessel 2 and, after the scraping and tamping plate 10 is set in the vessel 1 with the rod 8 extending upwardly out of the vessel 1, the cover 4 is sealingly secured to the vessel 2 with the rod 8 passing through the constricted end 7*a* of the member 7. Then, the positive pressure inert gas such as Ar is introduced into the interior of the vessel 1 through the inlet 6 which gradually leaks away through the annular clearance 9 so that an atmosphere protected by the inert gas is maintained in the interior of the vessel 1.

The heater section 11, 12 and 13 are energized so as maintain the temperature of the molten aluminum 3 in the vessel 1 at the desired temperature distribution along the height of the vessel 1.

Then, the cooling gas such as compressed air is introduced into the cooling passage 16 from the inlet 16*a* and discharged from the outlet 16*b*. Thus, the peripheral portion 1*a* of the inner surface of the vessel 1 surrounded by the annular cooling passage 16 is cooled to a temperature below the melting point of the molten aluminum 3 thereby resulting in partial crystallization of the molten aluminum 3 onto the cooled peripheral portion 1*a* so as to obtain refined or purified primary crystal of aluminum thereon.

The scraping and tamping plate 10 is periodically and reciprocally moved upwardly and downwardly passing through the range of the cooled peripheral portion 1*a* thereby scraping off the solidified refined aluminum on the peripheral portion 1a so as to deposit the scraped aluminum onto the bottom of the vessel 1. The scraped aluminum existing above the plate 10 in floating state is deposited through the throughhole 10*a* or the cut-out portion in the periphery of the plate 10. During depositing of the primary crystal of aluminum onto the bottom of the vessel 1, it tends to grow to larger purified crystal of aluminum.

After a certain time after a suitable amount of solidified aluminum has been deposited and heapted up on the bottom of the vesel 1, the heap of the deposited aluminum is tamped or compacted by the scraping and tamping plate 10 thereby permitting impure liquid existing within the deposited aluminum to be pressed out of the heap of aluminum upwardly therefrom so as to achieve further purified heap of aluminum.

The above described steps of refining operation are repeated until the level of the tamped heap of aluminum reaches a positive first below the cooling passage 16.

In order to facilitate the tamping operation, each of the heater sections is so regulated that the temperature of the level of the deposited aluminum is held at about 690° C. so as to allow partial melting of the deposited aluminum at the level thereof during the tamping operation so as to obtain further purified grown crystal of aluminum and the temperature of the molten aluminum above the level of the heap of deposited aluminum is held at about 660° C. so as to prevent solidification of aluminum, while the heater sections 12, 13 positioned below the level of the heap of solidified aluminum are deenergized beginning at the lowermost one or the supply of electric power thereto is decreased so as to save the electric power for the refining process.

When the tamped heap of aluminum reaches just below the cooling passage 16, the supply of the cooling gas to the cooling passage 16 is stopped, and, after the scraping and tamping plate 10 is reciprocated upwardly and downwardly several times, the cover 4 and the plate 10 and removed from the vessel 1 and the impure liquid existing above the heap of aluminum is removed by a siphon, for example. Thereafter, the tamped heap of aluminum is removed from the vessel 1 and is cut at a position so as to achieve the desired purity of aluminum.

EXAMPLE 1

Using an aluminum refining apparatus similar to that shown in FIG. 1 and provided therein a graphite crucible having the inner diameter of 100 mm and the height of 500 mm, 8 kg of aluminum containing 747 ppm Fe, 436 ppm Si and 26 ppm Cu was molten in the graphite crucible and was refined using the segregation solidification process as described above under the atmosphere protected by positive pressure Ar. The primary crystal formed on the cooling surface was scraped off by a scraping and tamping graphite plate having four throughholes of 10 mm diameter at the time interval of 20 seconds and the deposited aluminum was tamped by the scraping and tamping plate at the time interval of 5 minutes. After 80% of the molten aluminum was solidified in 2 hours, the concentrated impure liquid was removed. 10% of the upper end of the solidified aluminum was cut off and the remaining portion was used as the refined aluminum. The refined aluminum included 24 ppm Fe, 30 ppm Si, 6 ppm Cu.

Figure 2:
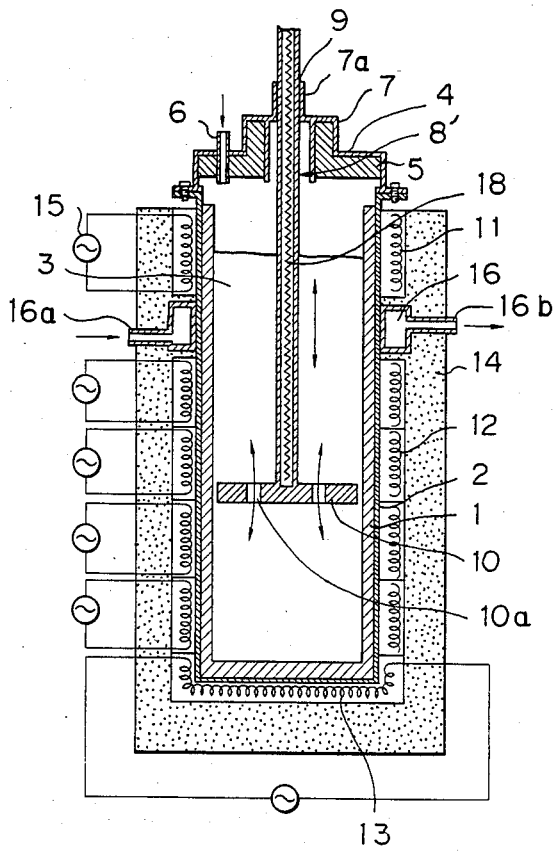
FIG. 2 is a vertical cross-sectional view similar to FIG. 1 but showing a modified form of the apparatus shown in FIG. 1.

FIG. 2 shows a modified form of the apparatus shown in FIG. 1.

Figure 3:
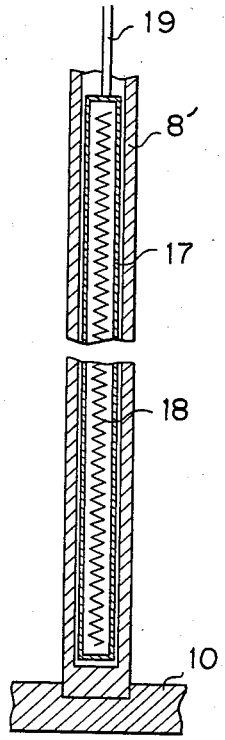
FIG. 3 is a vertical cross-sectional view showing the heater section arranged in the rod of the scraping and tamping plate of the apparatus shown in FIG. 2.

The general construction of the apparatus of FIG. 2 is substantially similar to that of FIG. 1 except that an insulating tube 17 (FIG. 3) and an electric heater segment or section 18 located in the tube 17 are arranged extending in the hollow portion in the graphite rod 8' secured to the scraping and tamping plate 10. The heater section 18 is energized by an external electric source (not shown) thorugh lead wires 19.

In the form of the apparatus shown in FIG. 1, since the rod 8 is normally positioned at the elevated position during the partial crystallization of the molten aluminum onto the cooling surface and moved downwardly for the scraping and tamping operation by the scraping and tamping plate 10, the height of the cylindrical member 7 should be made great in order to prevent the rod 8 from moving of the cover 4 resulting in lowering of the temperature of the rod 8 below the melting point of aluminum, otherwise partial crystallization of aluminum onto the outer surface of the rod 8 might occur when it is moved downwardly for the scraping and tamping operations thereby causing damage to the constricted end 7*a* of the cylindrical member 7 when the rod 8 reciprocates.

The apparatus of FIG. 2 positively avoids the disadvantage of the apparatus of FIG. 1 while the height of the cylindrical member 7 is kept reduced by virtue of the provision of the heater section 18 in the rod 8′ to maintain the temperature of the rod 8′ above the melting point of aluminum even though it moves out of the cover 4. The length of the heater section 18 may be such as extending between the two portions contacting with the level of the molten aluminum 3 at the raised and lowered positions of the rod 8, respectively.

Figure 4:
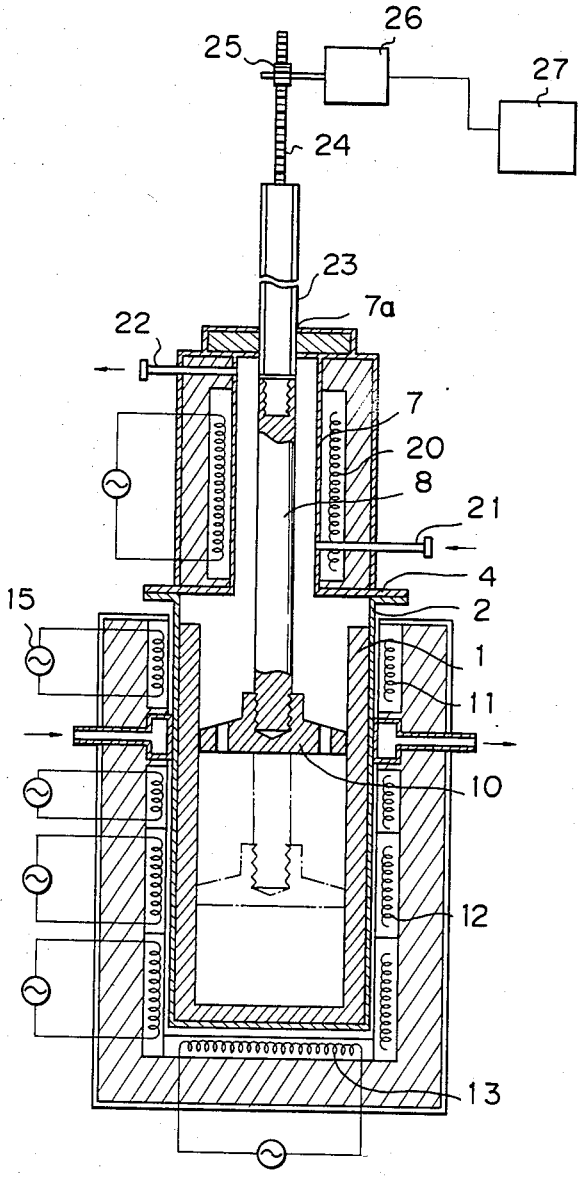
FIG. 4 is a vertical cross-sectional view showing a further modified form of the apparatus shown in FIG. 1.

FIG. 4 shows a further modified form of the apparatus of FIG. 2. In this embodiment, the general construction is similar to that of FIG. 1, but an electric heater segment or section 20 is provided around the cylindrical member 7 and is enclosed by a heat insulating structure 21. The inert gas is introduced into the interior of the cylindrical member 7 communicating with the interior of the vessel 1 through an inlet 21 and discharged through an outlet 22. The upper end of the rod 8 is connected to the lower end of a connecting rod 23 which is slidably fitted in the constricted end 7*a* of the member 7, the upper end of the rod 23 being connected to a rack 24 which is in engagement of a pinion 25 driven by a driving means 26 for the operation of the plate 10, the operation of the driving means 26 being controlled by a controller 27 connected thereto. Thus, the rod 8 is located at all times in the member 7 which is heated by the heater section 20 so that the partial crystallization of aluminum on the outer surface of the rod 8 is positively prevented. In this, embodiment, the scraping and tamping plate 10 is shown as a separate member from the rod 8 and secured thereto by the mating screw threads forming in both the plate 10 and the rod 8.

Figure 5:
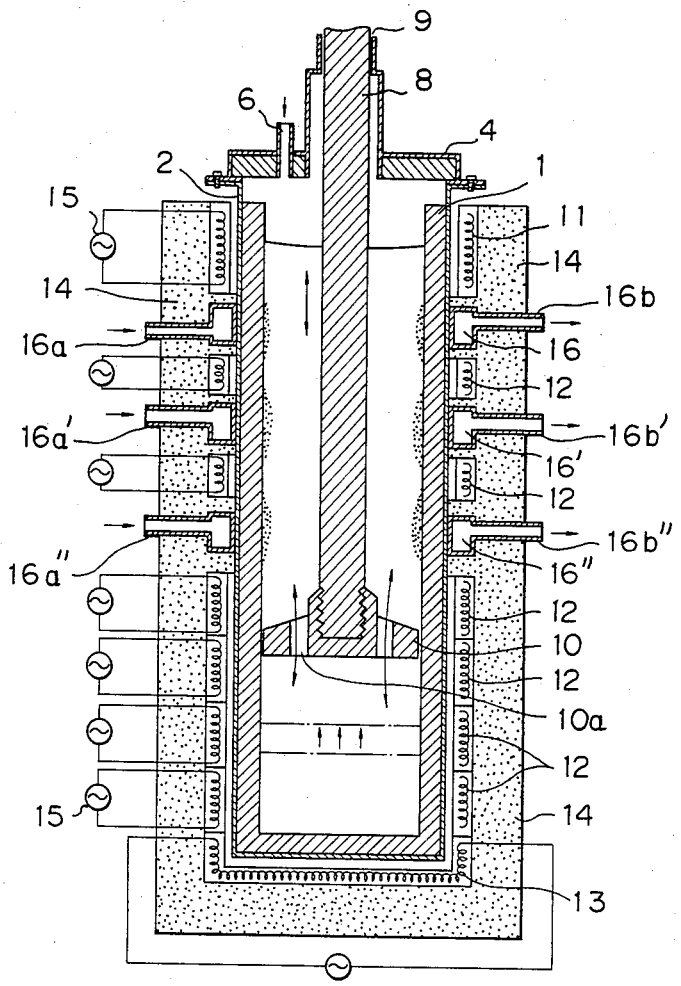
FIG. 5 is a vertical cross-sectional view showing a second embodiment of the apparatus of the present invention.

FIG. 5 shows a second embodiment of the apparatus of the present invention. The general construction of this embodiment is substantially similar to that of FIG. 1 except that additional cooling sections or passages 16′, 16″ . . . are provided so as to increase the productivity of the apparatus.

The additional cooling passages 16′, 16″ are similar in construction to that of the cooling passage 16 and at least a heater section 12 is interposed between adjacent two cooling passages.

In operation, all the heater sections and the cooling passages are set in operative conditions and the scraping and tamping operation by the scraping and tamping plate 10 are repeated as described previously until the level of the tamped heap of aluminum reaches just below the lowermost cooling passage 16″. Then, the supply of the cooling gas to the lowermost cooling passage 16″ is stopped and the heater section 12 immediately above the now inactivated cooling passage 16″ is regulated so as to render the temperature of the peripheral portion of the inner surface positioned at the heater section 12 immediately above the lowermost cooling passage 16″ to be about 690° C. for facilitating the effective tamping of the deposited heap of aluminum, while the heater sections above the second cooling passage 16′ are left regulated to render the temperature of the corresponding inner surface to be about 660° C. and to heater sections below the lowermost cooling passage 16″ are deenergized or the supply of electric power to these heater section is decreased so as to save the consumption of electric power. This procedure is repeated until the level of the tamped heap of aluminum reaches just below the uppermost cooling passage 16. Then the cover 4 and the scraping and tamping plate 10 are removed, the impure liquid is removed and the tamped heap of aluminum is taken out and cut-off as desired as previously described.

This construction makes it possible to construct a tall vessel having a greater efficiency for the refining of aluminum by virtue of the provision of a plurality of cooling passages without deteriorating the high quality of the refined aluminum.

EXAMPLE 2

Using an aluminum refining apparatus similar to that shown in FIG. 5 and provided therein with a graphite crucible having the inner diameter of 200 mm and the height of 800 mm, 50 kg of aluminum containing 850 ppm Fe, 410 ppm Si and 29 ppm Cu was molten in the graphite crucible and was refined using the segregation solidification process as described above under the atmosphere protected by positive pressure Ar. The primary crystal formed in the cooling surface was scraped off by a scraping and tamping graphite plate having eight throughholes of 20 mm diameter at the time interval of 20 seconds and the deposited aluminum was tamped at the time interval of 5 minutes. After 80% of the molten aluminum was solidified in 7 hours, the concentrated impure liquid was removed. 10% of the upper end of the solidified aluminum was cut off and the remaining portion was used as the refined aluminum was carried out by remelting the same. The result showed the components of 26 ppm Fe, 28 ppm Si and 6 ppm Cu, the balance being aluminum.

Figure 6:
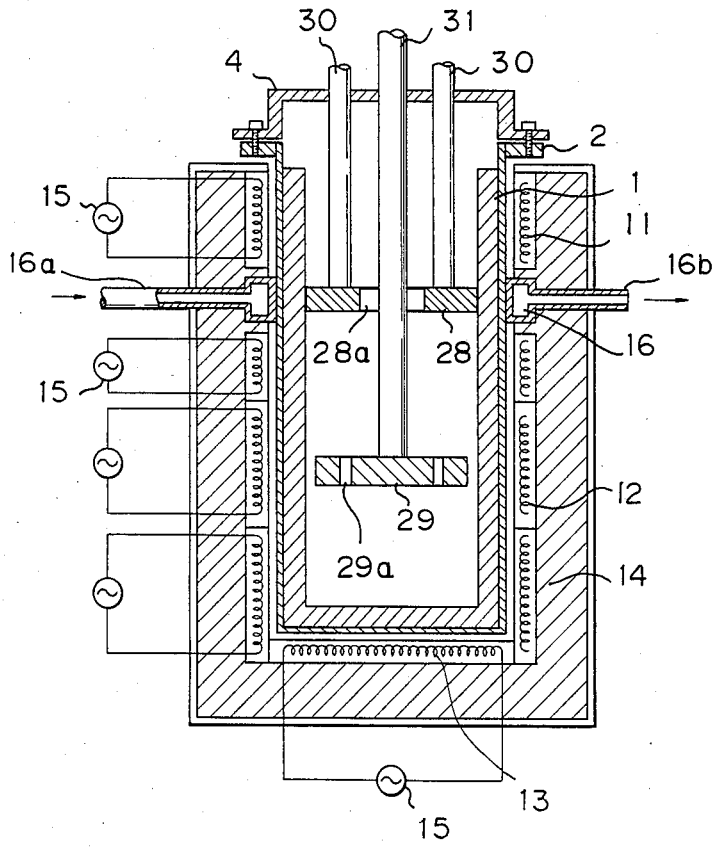
FIG. 6 is a vertical cross-sectional view showing a third embodiment of the apparatus of the present invention.

Finally, FIG. 6 shows a third embodiment of the apparatus of the present invention.

This embodiment is substantially similar in general construction to that shown in FIG. 1 except that the scraping and tamping plate 10 of FIG. 1 is substituted by separate two members, i.e. a scaping plate 28 and a tamping plate 29 having at least a throughhole 29*a*.

The scraping plate 28 has a large diameter central opening 28*a* through which a rod 31 secured at its lower end to the tamping plate 29 loosely passes and is driven upwardly and donwardly at an appropriate time interval for effecting the tamping operation as described previously. The large opening 28*a* facilitates depositing of solidified and scraped aluminum existing above the plate 28. The periphery of the scraping plate 28 has the cross-sectional configuration substantially similar to that of the inner surface of the vessel 1 as described previously and two rods 30, 30 are secured at their lower ends to the plate 28 for reciprocating movement at an uppropriate time interval for the scraping operation as described previously. The size of the tamping plate 29 is made smaller than that of the inner surface of the vessel 1 so as to leave annular clearance therebetween for facilitating depositing of solidified aluminum.

As described previously, the scraping operation is preferably effected at the time interval of 5–120 seconds and the tamping operation is preferably effected at the time interval of 3–30 seconds separately or independently of the scraping operation. Therefore, the construction of the tamping plate 29 separate from the scraping plate 28 shown in FIG. 6 and the operation of the tamping plate 29 independently of that of the scraping plate 28 greatly improve the efficiency and productivity of the refining of aluminum in accordance with the present invention.

We claim:

1. In a process for refining aluminum using a segregation solidification process under an atmosphere of positive pressure inert gas and including the steps of pouring molten aluminum into a vessel, heating said vessel to maintain the molten aluminum at an appropriate temperature, partially crystallizing said molten aluminum by a cooling surface area located in said vessel to form primary crystals of aluminum onto said cooling surface area, scraping off the refined and solidified aluminum from said area to form a heap on the bottom of said vessel, tamping the deposited heap to press out the impure liquid existing within the heap of the solidified aluminum upwardly of the level of the tamped aluminum, removing the liquid existing above the thus tamped heap of aluminum, and taking out said tamped aluminum from said vessel, the improvement comprising maintaining an appropriate temperature of the molten aluminum in said vessel by means of a plurality of electric heater means arranged around the periphery of said vessel in vertically superposed relationship to each other, cooling a narrow peripheral portion of the inner surface of said vessel beneath the level of the molten aluminum therein by peripheral cooling means arranged around the periphery of said vessel between adjacent two heater sections to crystallize the molten aluminum onto said peripheral portion of the inner surface of said vessel, scraping off refined and solidified aluminum on said peripheral portion by scraping and tamping means having a cross-sectional configuration substantially complementary to that of the inner surface of said vessel, tamping the heaped aluminum by said scraping and tamping means, and deenergizing some of said heater sections located at positions around the solidified heap of aluminum.

2. A process according to claim 1, wherein said partial crystallization of the molten aluminum is effected by said cooling section in the form of an annular passage located around the periphery of said vessel and provided with an inlet for introducing cooling medium at a position of said passage and an outlet for discharging said cooling medium at an opposite position thereof after cooling.

3. A process according to claim 1, wherein said partial crystallization of the molten aluminum is effected by a plurality of cooling sections arranged around the periphery of said vessel in vertically superposed relationship to each other with at least a heater section being positioned at either side each of said cooling sections, said cooling sections being rendered to be successively inoperable beginning at the lowermost one as the level of said tamped heap of aluminum reaches the cooling section above that having been rendered to be inoperable.

4. In an apparatus for refining aluminum comprising a vessel for maintaining molten aluminum therein, a cover for keeping the interior of said vessel under the atmosphere protected by positive pressure inert gas, heating means for maintaining the molten aluminum in said vessel at an appropriate temperature, a cooling surface area located in said vessel for partially crystallizing the molten aluminum onto said cooling surface area, scraping and tamping means for scraping off the solidifed aluminum on said cooling surface area to deposit the same onto the bottom of said vessel and for tamping the deposited aluminum for pressing out impure liquid existing within the deposited aluminum, the improvement wherein said heating means comprises a plurality of electric heater means arranged around the periphery of said vessel in vertically superposed relationship to each other, said cooling surface area comprises a narrow peripheral portion of the inner surface of said vessel beneath the level of the molten aluminum in said vessel cooled by a cooling means located around the periphery of said vessel between two adjacent heating means, while said scraping and tamping means comprises a scraping and tamping plate having a cross-sectional configuration substantially complementary to that of the inner surface of said vessel.

5. An apparatus according to claim 4, wherein said scraping and tamping plate is driven by a rod secured thereto and extending upwardly therefrom with a portion of said rod being adapted to pass thorugh a hole formed in said cover.

6. An apparatus according to claim 4, wherein said cooling section is in the form of an annular passage located around the periphery of said vessel between adjacent two heater sections and is provided with an inlet for introducing cooling medium at a position of said passage and an outlet for discharing said cooling medium at an opposite position thereof after cooling.

7. An apparatus according to claim 4, wherein a plurality of cooling sections are arranged around the periphery of said vessel in vertically superposed relationship to each other with at least a heater section being located at either side each of said cooling sections, said cooling sections being rendered to be inoperative beginning at the lowermost one as the level of said tamped heap of aluminum reaches the cooling section concerned.

8. An apparatus according to claim 7, wherein each of said cooling sections is in the form of an annular passage located around the periphery of said vessel between adjacent two heater sections and provided with an inlet for introducing cooling medium at a position of said passage and an outlet for discharging said cooling medium at an opposite position thereof after cooling.

* * * * *